US006027095A

United States Patent [19]

Kraft et al.

[11] Patent Number: 6,027,095

[45] Date of Patent: Feb. 22, 2000

[54] PIPE BREAKAGE SAFETY VALVE

[75] Inventors: Edmund Kraft, Karlstadt; Günter Fertig, Wertheim; Walter Kirsch, Fammersbach, all of Germany

[73] Assignee: Mannesman Rexroth AG, Lor/Maine, Germany

[21] Appl. No.: 08/935,736

[22] Filed: Sep. 23, 1997

[51] Int. Cl.[7] ..... F15B 13/01

[52] U.S. Cl. ..... 251/28; 251/63; 137/625.34

[58] Field of Search ..... 251/28, 63; 137/625.34

[56] References Cited

U.S. PATENT DOCUMENTS

| | | | |
|---|---|---|---|
| 4,187,870 | 2/1980 | Akkerman | 251/28 X |
| 5,381,822 | 1/1995 | Christensen . | |

FOREIGN PATENT DOCUMENTS

| | | |
|---|---|---|
| 0197467 | 3/1986 | European Pat. Off. . |
| 2187086 | 1/1974 | France . |
| 2536106 | 2/1977 | Germany . |
| 2091383 | 7/1982 | Germany . |
| 3239930 | 5/1984 | Germany . |
| 3319810 | 10/1984 | Germany . |
| 4032420 | 4/1994 | Germany . |

*Primary Examiner*—Kevin Lee
*Attorney, Agent, or Firm*—Mayer, Brown & Platt

[57] ABSTRACT

The invention is a pipe rupture valve having an internal servovale that comprises a valve piston that, in a setting at a steering edge, blocks the connection between two internal pressure connections of the servovalve. At a distance axially to said steering edge the valve piston has an additional steering edge that separates, sealed against fluids, a preloaded spring of the valve piston (or a spring area accommodating this spring) from the pressure connections.

21 Claims, 4 Drawing Sheets

P ST
18
19
31
9
5
30
35
1
H
33
34
29
10
L
13
8
12
11
27
28
3
17
26
25
7
2
6
V
16
32
4
22
24
14
20
23
M
15
21

PIPE BREAKAGE SAFETY VALVE

FIELD OF INVENTION

The invention is a pipe rupture valve, especially a brake/block valve having an integrated servovalve.

BACKGROUND OF THE INVENTION

These types of valves are employed, for instance, as dynamic lowering brake/block valves for regulating the outflow of a hydraulic device that is loaded by external forces (a lifting cylinder, for example) in order to prevent the hydraulic device from getting ahead of the feed flow. At the same time, in cases in which they are designed as seat pistons, these valves assume the function of a leakage-free, blocking, steered non-return valve that clamps the hydraulic device in position.

It is known from the prior art pursuant to DE-OS 32 39 930 which is a brake/block valve that in a special exemplary embodiment is designed with a positive opening non-return valve. This known brake/block valve comprises a first hollow valve piston having an interior valve seat that can be closed via a valve plunger that is pre-loaded in the closed position. The interior valve seat is in communication with a first pump-side valve pressure connection via a first radial bore provided in the valve piston. A second radial bore arranged behind the valve seat is connected via an annular channel to an additional valve seat of the non-return valve, which blocks a second hydraulic device-side valve pressure connection. A pressure limiting valve is also integrated into the non-return valve. The aforesaid valve piston furthermore has additional small diameter radial bores immediately in front of the interior valve seat and is pre-loaded via a spring in a position in which communication between the annular channel and the small diameter radial bores is interrupted.

For lifting a load, hydraulic fluid flows from the first valve pressure connection through the valve piston, the interior valve seat, the annular channel, the valve seat of the non-return valve to the second valve pressure connection and is forwarded from there to the hydraulic device. If the load is to be maintained in a certain position, the non-return valve is pressed onto the valve seat via a spring; when the pumping pressure decreases, the hydraulic pressure acts on the second valve pressure connection and therefore on the hydraulic device. For lowering the load in this known device, the valve piston and the piston of the non-return valve are caused to move against the pre-loaded spring by the pressure in a control pressure line, a fluid connection being produced between the second valve pressure connection (via the valve seat of the non-return valve, now positively opened, the annular channel, and the small diameter radial bores) and the first valve pressure connection, which in this case is connected to a tank via an external directional control valve.

From the preceding description of the prior art it can be seen that the overall structure of the brake/block valve is extremely complex given the two valve pistons, each of which must be actuated via a control pressure, and this fact leads to relatively large structural dimensions and furthermore to increased pressure losses caused by leakage.

A brake/block valve that is the equivalent of that illustrated in DE-OS 2 352 742 was developed with the goal of keeping losses due to leakage as small as possible; it is the prior art closest to the subject of the invention.

This valve comprises a hollow valve piston that is pre-loaded via a spring against a valve seat that connects two valve pressure connections, the spring being located in a spring area. Also located in the valve piston is an internal pilot seat valve that can be positively opened by means of a setting piston that can be actuated by a control pressure. The brake/block valve is also parallel-switched with both of its connections to a non-return valve arranged in a pressure line leading to the hydraulic device, the spring area being permanently subjected to the load pressure.

When a load is lifted, the pressure connection located upstream of the non-return valve is subjected to pump pressure that is elevated relative to the load pressure prevailing in the connection located downstream of the non-return valve, corresponding to the force of the spring in the non-return valve, the valve piston being pressed by both the piston spring and the load pressure prevailing in the spring area on the valve seat. If the load is to be maintained in one position, the external non-return valve closes, while the valve piston of the brake/block valve is further held in the closed position and therefore the pump-side valve connection is essentially without pressure. For lowering the load, the setting piston is actuated for opening the internal pilot seat valve, this releasing the pressure in the spring area. Additional actuation of the setting piston causes the valve piston to be raised by the valve seat and therefore the hydraulic device pressure is released into a tank.

It has been demonstrated that in this type of valve design the varying level of the pressure on the pump-side valve connection has a negative effect on the control of the valve piston. In addition, the brake/block valve housing (especially for the spring area) must be heavy and particularly well-sealed against fluids since it is subjected to the load pressure continuously and therefore must be able to withstand it.

Given this most recent prior art, it is therefore the object of the invention to create a brake/block valve, preferably as a pipe rupture valve, the structure of which is less complex and less expensive.

SUMMARY OF THE INVENTION

The invention achieves this object by means of the pipe rupture valve having the features given in a first embodiment. Consequently, the pipe rupture valve in accordance with the invention comprises a servovalve having at least two internal pressure connections and one valve piston that is pre-loaded via a pre-loaded spring in a first position that separates the pressure connections. For this purpose, the valve piston has a first steering edge by means of which one of the pressure connections can be closed. Provided at a distance axially to the first steering edge is a second steering edge that seals the pre-loaded spring with respect to the pressure connections. As a result of these special measures, the housing of the pipe rupture valve can be relatively weak (especially in the region of the pre-loaded spring), as can the seals provided in this housing region, because they are not directly subjected to the working pressure acting on the valve. This means that monetary savings can be realized in terms of selection of materials and constructive design.

A further development of the subject of the invention provides that the first steering edge constitutes a valve disc that can, by the force of the pre-loaded spring, be made to adjoin a valve seat constituting the one pressure connection. The valve seat constitutes a sleeve that is inserted into an accommodating bore bored into the housing of the pipe rupture valve. This design makes it possible to a certain extent to pre-assemble the servovalve completely (and therefore more cost-effectively) before it is inserted into the pipe rupture valve.

In accordance with the further embodiment, the second steering edge constitutes an annular collar formed on the valve piston, the annular collar acting as a sliding bearing, an additional annular collar between the first and second steering edge being provided immediately adjacent to the first steering edge, it also acting as a sliding glide for the valve piston. In this manner the second steering edge, designed as a single piece at the valve piston, accomplishes two functions, thus simplifying the entire structure of the control piston.

The further development furthermore provides that the pipe rupture valve comprises a valve connection that can be connected to a pump or a tank, selectably, and a hydraulic device connection; these are connected to each other via a pressure forwarding channel having an inserted pressure control/feed valve to which a return channel is parallel switched, into which the servovalve is inserted. The integral arrangement of the combined pressure/feed valve simplifies not only the channel guide inside the pipe rupture valve, but also its assembly, the result being savings in terms of costs.

Given in the embodiment is the additional measure of designing on the side of the valve piston opposite the pre-loaded spring a hollow space that is separated by a single-piece annular collar arranged on the valve piston from a hydraulic device chamber guiding the working pressure. The hollow space is connected to the hydraulic device chamber preferably via a choke point formed by the annular collar, the hollow space in accordance with claim 12 being attached to a leakage line via a channel in which a pilot seat valve is seated. These measures make it possible to increase the spring force of the pre-loaded spring for closing the first pressure connection by means of building up pressure in the hollow space. In addition, a type of functional assurance is provided for the pipe rupture valve in the event that the pre-loaded spring breaks, since the pressure in the hollow space is great enough to itself move the valve piston to its closed position.

Furthermore, it is provided that the channel inside the valve piston is designed as a through-hole that runs axially, the valve piston for its axial displacement being able to be made to engage with a setting piston that chronologically prior to being made to engage puts the pilot seat valve arranged in the valve piston in an open position in order to release the pressure inside the hollow space into the leakage line. It is obvious that this cooperation among the specified components decreases the constructive complexity of the invention, this also contributing to a reduction in production costs.

Additional advantageous embodiments of the invention are the subjects of the other dependent claims.

DESCRIPTION OF THE DRAWINGS

The invention is explained in more detail in the following using preferred exemplary embodiments and referencing the accompanying drawings.

DETAILED DESCRIPTION OF THE PREFERRED EMBODIMENTS

Figure 1:
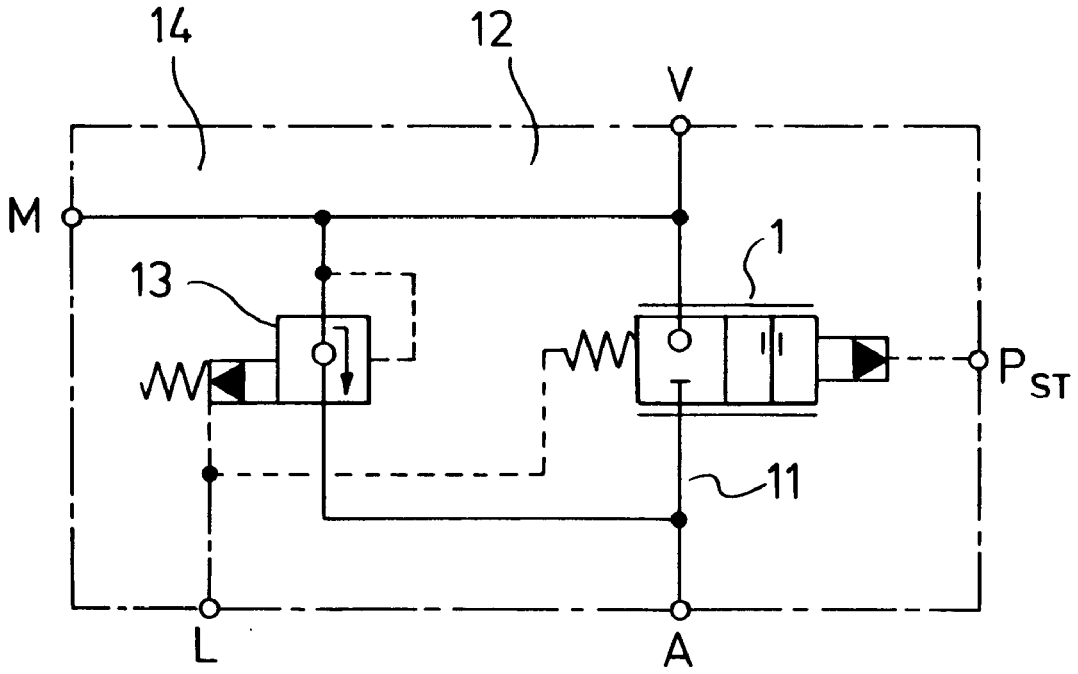
FIG. 1 is a diagram of a brake/block valve as a pipe rupture valve in accordance with the invention.
Figure 2:
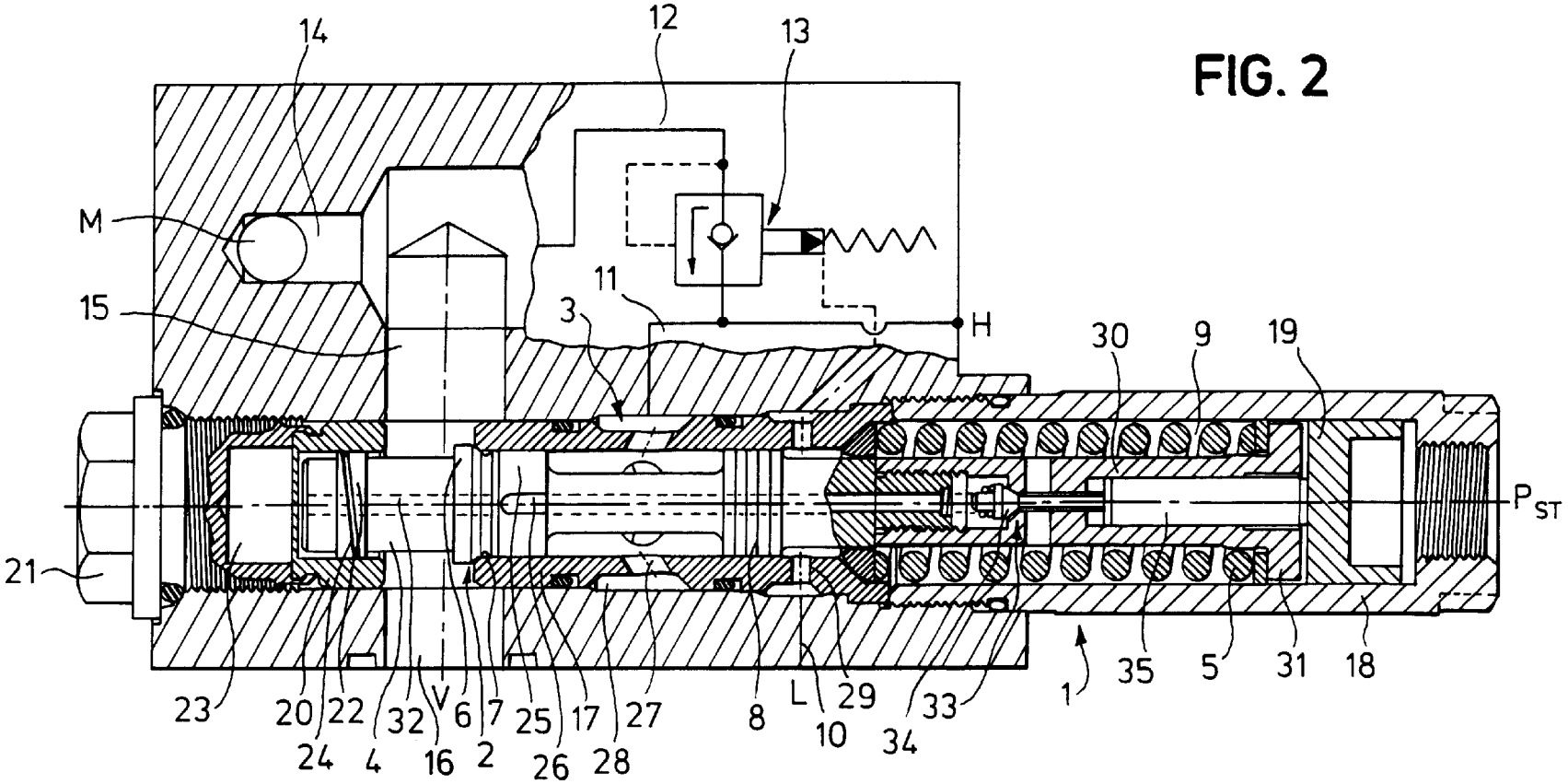
FIG. 2 illustrates a first embodiment of a brake/block valve in accordance with the invention in a position that pressure-actuates the hydraulic device, the valve piston being pressed by a pre-loaded spring as well as by the load pressure on its valve seat.

In accordance with FIG. 1, the basic structure of the brake/block valve as pipe rupture valve comprises an integrated servovalve 1 having at least two internal pressure connections 2 and 3 and one valve piston 4 that is pre-loaded by a pre-loaded spring 5 in a first position that separates the two pressure connections 2 and 3. As can be seen in FIG. 2, the valve piston 4 is therefore provided with a valve disc 6 in the shape of a section of a cone; it is pressed on a valve seat 7 by the pre-loaded spring 5. In accordance with the invention, provided at the valve piston 4, at a distance axially is a seal, in this case constituting an annular collar 8, which seals the pre-loaded spring 5 against the two pressure connections 2 and 3. A spring area 9 that accommodates the pre-loaded spring 5 and that is therefore pressure-free is then connected via an additional oil leakage line 10 to a separate tank connection L.

As is shown particularly in FIG. 1, the servovalve 1 is inserted in a return channel 11 that is in a brake/block valve; the return channel 11 connects a hydraulic device-side valve connection V to an additional valve connection A, which itself can be selectably attached via an external directional control valve (not shown) to either a pump or a tank. In accordance with the invention, the servovalve 1 is designed to be actuated by means of a control pressure that can be applied to the brake/block valve via an external control connection $P_{st}$. Furthermore, parallel to the return channel 11 there is a forwarding channel 12 that bypasses or bridges the servovalve 1, especially its pressure connection 2, in which is inserted, in accordance with the invention, a combined pilot pressure/feed valve 13 like that marketed by Applicant under the "MHDBN 22K" model label and which therefore belongs to the state of the art. In addition, a measurement connection M for a pressure sensor is provided for monitoring pressure at the hydraulic device connection V; the connection M is connected directly to the connection V or can be employed for an equalizing line in double cylinders.

FIG. 2 is referred to now for an explanation of the constructive structure of the brake/block valve in accordance with the invention, especially its servovalve 1 in accordance with a first exemplary embodiment.

As can be seen in FIG. 2, the measurement connection M is connected via a first channel 14 to a hydraulic device chamber 15 in a valve housing, out of which a bore 16 leads to the hydraulic device connection V, as per FIG. 2. The hydraulic device chamber 15, i.e., the bore 16, is then essentially penetrated at a right angle by an additional valve housing bore for accommodating the servovalve 1, the bore running through the entire valve housing and effectively separated into two parts by the hydraulic device chamber 15. A sleeve 17 is sealed against fluids in the right-hand part of the bore per FIG. 2; it performs as a sliding bearing for the valve piston 4 and its end opening into the hydraulic device chamber 15 constitutes the valve seat 7. As can be seen in FIG. 2, the sleeve 17 is pressed against a shoulder in the valve housing bore by means of a lining 18 threaded into the valve housing and having an interior bore diameter that is greater than that of the sleeve 17, the sleeve 17 being fixed axially. The lining 18 therefore forms the aforementioned spring area 9, which is closed against the exterior by a face of the lining 18. In the face is the control pressure connection $P_{st}$ for a control pressure line through which a setting piston 19 sliding in the lining 18 can be actuated by the control pressure.

In accordance with FIG. 2, threaded into the left-hand part of the bore there is also a sleeve 20 having an interior diameter that is equal to that of the right-hand sleeve 17 and countered by a hollow screw 21, the left-hand part of the bore being closed against its surroundings by means of a filler plug constituting a set screw (not shown in more detail) threaded into the hollow screw. The valve piston 4 extends through the hydraulic device chamber 15 into the left-hand sleeve 20 and is slide-borne there inside the sleeve 20 by an annular collar 22 on the valve piston 4, a hollow space 23 being formed inside the sleeve 20 between the filler plug and the left-hand annular collar 22. A connection channel 24 having a choke function is inserted in a spiral at the lateral surface of the annular collar 22; this ensures that the prevailing pressure in the hydraulic device chamber 15 gradually builds up through the connection channel 24 in the hollow space 23 and thereby presses the valve piston 4 and therefore the opposing section of a cone 6 against the valve seat 7.

As has already been mentioned in the foregoing, the valve piston 4 is furthermore also slide-borne in the right-hand sleeve 17 in accordance with FIG. 2, the base points constituting, first, the annular collar 8 acting as seal, and second, an additional annular collar 25 of the valve piston 4 immediately adjacent to the section of the cone 6. This second annular collar 25, arranged at the section of a cone 6, has on its lateral surface, axial notches 26 that are open in the direction of the sealing annular collar 8 and that act as so-called fine-control grooves. Between the two annular collars 6 and 25, the sleeve 17 is provided with a plurality of radial bores 27 that are positioned in a circular plane, that can be separated from the hydraulic device chamber 15 by the section of a cone 6, and that open into an external annular channel 28 inserted into the sleeve 17, it being in fluid communication with the return channel 11 leading to the valve connection A. In accordance with FIG. 2, at a right-hand end section of the sleeve 17, provided between the annular collar 8 constituting the seal and the lining 18 in the sleeve 17, is an additional radial outflow bore 29 that leads to the oil leakage line 10 and that therefore connects the spring area 9 to the oil leakage line 10 or to the oil leakage connection L. The position of the outflow bore 29 is therefore selected such that each setting of the valve piston 4 ensures that the outlet bore 29 is separated from the return channel 11 leading to the valve connection A, this separation being effected by the sealing annular collar 8, while at the same time ensuring that there is a permanent connection between the outlet bore 29 and the spring area 9.

In accordance with FIG. 2, the right-hand end section of the valve piston 4 extends into the spring area 9 of the lining 18 by means of an extension 30 threaded into or onto the valve piston, this being radially enlarged on the right-hand external extension end into an annular collar-shaped spring seat 31 that supports the one end of the pre-loaded spring 5 arranged around the valve piston extension 30. The other end of the spring 5 is then itself supported on the right-hand face of the sleeve 17, causing the valve piston 4 to be pre-loaded to the right with respect to the sleeve 17 in accordance with FIG. 2 and therefore the section of a cone 6 under the support of the pressure prevailing in the left-hand side hollow space 23 is pressed against the valve seat 7. The valve piston 4 and the extension 30 are provided with an internal, axial through-hole 32 that connects the left-hand hollow space 23 to the spring area 9. Arranged in this through-hole 32, at the left-hand end section of the valve piston extension 30 (i.e., between the valve piston 4 and the extension 30), is a pilot valve 33 in a seat construction comprising a closing element 34 that, supported by the pressure in the left-hand hollow space 23, is pressed by means of a spring against an internal valve seat and that can be caused to move into an open position by means of the setting piston 19 through two spacing pins 35 additionally borne in the through-hole 32 of the valve piston extension 30. The valve seat of the pilot valve 33 is thus connected to the spring area 9 via a radial bore inserted in the valve piston extension 30.

Furthermore in the valve housing is an additional accommodating bore (not shown in FIG. 2) constituting the conventional combined pressure/feed valve 13, which for the sake of better understanding is indicated only as a switching symbol.

As has already been described in the foregoing, the pilot pressure/feed valve 13 in accordance with FIG. 2 is inserted in the pressure forwarding channel 12, which branches off from the return channel 11 between the valve connection A and the servovalve 1 and opens into the hydraulic device chamber 15, bypassing the pressure connection 2 of the servovalve 1. The pilot pressure/feed valve 13 therefore constitutes a non-return valve opening to the hydraulic device chamber 15 that is held in the closed position at a control side by a pre-loaded spring and which can be caused to move to the open position by pump pressure introduced via the valve connection A. At the same time, this non-return valve is combined with a pilot pressure-limiting valve that is controlled through an internal control line by pressure in the hydraulic device chamber and that releases the pressure in the hydraulic device chamber 15 into the return line 11 when a prescribed limiting value is exceeded.

The manner in which the brake/block valve functions in accordance with the first exemplary embodiment described in the foregoing can be outlined as follows:

When pressure is forwarded to a hydraulic device (not shown e.g., to a lifting cylinder for lifting a load) by appropriate actuation of one of the conventional direction control valves (not shown) connected in series to the brake/block valve, hydraulic fluid flows through the pressure connection A, opens the non-return valve of the combined pressure control/feed valve 13 against the force of the pre-loaded spring, flows through the pressure forwarding channel 12 and the internal hydraulic device chamber 15 of the brake/block valve, and reaches the hydraulic device connection V to which a hydraulic device line is attached (not shown). As described in the foregoing, the section of the cone 6 of the valve piston 4 sits fixed by the pre-loaded force of its pre-loaded spring 5 on its valve seat 7 and the annular collar 8, that is at the valve piston 4, acting as a seal separating the spring chamber 9 from the return channel 11, which is now also under pump pressure, so that no hydraulic fluid can escape through the spring area 9 and through the subsequent oil leakage connection L.

It is obvious that because of this structural measure (i.e., the arrangement of the annular collar 8 acting as a seal), the lining 18 constituting the spring area 9 and the seals provided at the lining 18 can be designed to be weak because these components are not subjected to the pump pressure.

For holding a load in a prescribed position (i.e., for a case in which the pressure in the hydraulic device is to be maintained at a prescribed value), the pump pressure is simply decreased, moving the non-return valve of the combined pressure control/feed valve 13 to its closed position. During the pressure actuation of the hydraulic device, the hydraulic device pressure from the hydraulic device chamber 15 has already built up in accordance with FIG. 2 in the left-hand hollow space 23 through the connecting channel 24 acting as the choke, and also acting on the valve connection A because of the drop in pressure and therefore acting in the return channel 11 on the valve piston 4 and its section of the cone 6 also presses on its valve seat 7 because of the prevailing imbalance of forces in addition to the spring force. In this manner it is ensured that the hydraulic device remains in its position with no oil leakage. For that instance in which pressure peaks occur in the hydraulic device in this switching mode (e.g., because of oscillations or vibrations that would mean overloading the brake/block valve or the subsequent lines), the pressure control/feed valve 13 (also functioning as pilot pressure limiting valve) opens in order to release a certain amount of hydraulic fluid from the hydraulic device chamber 15 into the return channel 11 that has no pressure.

At this point, if the hydraulic pressure in the hydraulic device is decreased (e.g., to lower a load), a control pressure is applied through the control pressure connection $P_{st}$ in the lining 18 arranged to the right in accordance with FIG. 2, this causing the setting piston 19 borne in the lining 18 to move to the left in accordance with FIG. 2 and the pilot seat valve 33 in the valve piston 4 is positive opened through the two spacing pins 35 arranged axially one behind the other. This causes the pressure in the left-hand hollow space 23 to be released into the oil leakage line 10 (hydraulic fluid flowing continuously through the connection channel 24 is less than hydraulic fluid flowing out through the pilot seat valve 33), and this reduces the force of pressure between the section of the cone 6 of the valve piston 4 and its valve seat 7 on the pre-loaded force generated by the pre-loaded spring 5.

At this point it should be remarked that the pressure actuating surface on the section of the cone 6 is essentially identical to that of the left-hand annular collar 22, so that pressure forces from the hydraulic device chamber 15 exerted on them counterbalance each other.

At this point, if the setting piston moves further to the left, it is adjacent to the right-hand face of the valve piston 4 (i.e., of the extension 30) and pushes the valve piston 4 against the pre-loaded force of the pre-loaded spring 5, which is exerted by itself now. This causes the section of the cone 6 to be lifted from its valve seat 7 so that the pressure prevailing in the hydraulic device (and therefore in the hydraulic device chamber 15) can be released through the return channel 11 to the valve connection A and from there to the tank (not shown).

Here it should be remarked that the maximum path along which the valve piston 4 can be pushed to the left is limited by the filler plug that constitutes a set screw. Furthermore, metering of the outflowing hydraulic fluid can be determined and/or adjusted exactly, since the force for displacing the valve piston 4 per the description in the foregoing is proportional solely to the spring force of the pre-loaded spring 9 and is independent of the hydraulic device pressure. This metering accuracy is additionally improved by the arrangement of the fine-control grooves 26, which permit a greater displacement path tolerance. The design of the hollow space 23 on the left-hand side of the valve piston 4 in accordance with FIG. 2 (on the valve piston side opposite the spring area) furthermore ensures functional maintenance of the brake/block valve, even if the pre-loaded spring 5 of the valve piston 4 is broken.

Given such conditions, if the control pressure is reduced, the closing element 34 of the pilot seat valve 33 arranged in the valve piston 4 is closed because of the pre-loaded force of the pre-loaded spring internal to the seat valve, causing pressure to build up gradually in the hollow space 23, the pressure corresponding to the pressure in the hydraulic device chamber 15. This pressure acts on the left-hand face of the valve piston 4 and displaces it to the right because of the imbalance in forces still prevailing at the section of the cone 6. This is how the section of the cone 6 can be moved back to the closed position so that the connection between the hydraulic device connection V and the valve connection A is interrupted. Also, since it is not subjected to hydraulic pressure, the valve piston extension 30 can be made of a material that is not capable of carrying such a heavy load and that is therefore less expensive because of the special arrangement of the hollow space 23 with respect to the spring area 9.

Finally, it should be noted that there can be numerous constructive modifications to the first exemplary embodiment of the invention, with the function remaining the same. For instance, the pressure control/feed valve 13 could be arranged externally or could be replaced with a separate non-return valve together with a pressure-limiting valve. Also, instead of the connecting channel 24, the annular collar 22 could simply be used in the sleeve 20 with greater play; this would create a gap between the two components that would have the same effect. Similar modifications are also offered in the exemplary embodiments described in the following, so that they will not be discussed in greater detail at this point.

Figure 3:
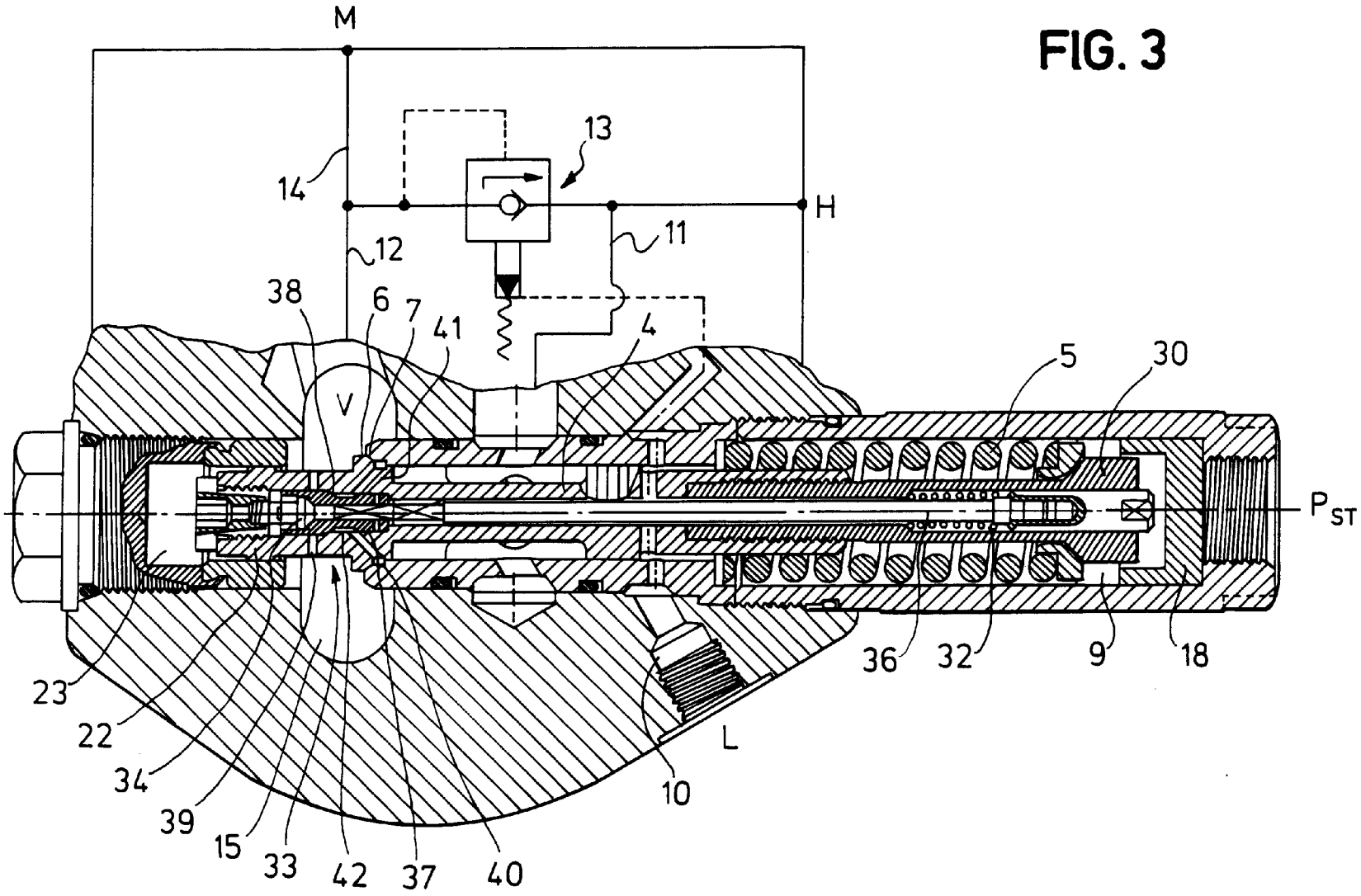
FIG. 3 illustrates an alternative design of the embodiment in accordance with FIG. 1, in the same position; and, FIG. 4 illustrates a second embodiment of the invention in a position that pressure-actuates the hydraulic device, the valve piston being pressed on the valve seat solely by the pre-loaded spring.

FIG. 3 illustrates an alternative design of the brake/block valve in accordance with the first exemplary embodiment; only the constructive differences shall be discussed in the following.

As can be seen in FIG. 3, the internal pilot seat valve 33 in this embodiment in accordance with the invention is located at the left-hand end section of the valve piston 4 inside the hydraulic device chamber 15, a pressure bar 36 being inserted into the internal through-hole 32 of the valve piston 4 and spring-loaded to the right in accordance with FIG. 3 for actuating the valve 33 through the setting piston 18. The pilot seat valve 33 is a closing element 34 pre-loaded on a valve seat, the element being displaceable in the opening direction by the pressure bar 36 via an inserted spacing pin 37. The closing element 34 is borne in an external sleeve 38 constituting the valve seat, which itself is borne axially displaceable in the valve piston 4 and can be actuated directly by the pressure bar 36. The sleeve 38 comprises an exterior shoulder that engages a corresponding shoulder in the through-hole 32 of the valve piston 4 for an axial displacement limit in the direction of the spring-load. In other words, the sleeve 38 is pressed by a pre-loaded spring of the closing element 34 via the valve seat against the shoulder in the through-hole 32 and can be raised therefrom by axial displacement of the pressure bar 36.

In the region of the exterior sleeve 38, the valve piston 4 is provided with radial bores 39 that produce a connection between the hydraulic device chamber 15 and the internal through-hole 32 of the valve piston 4. In the position of the valve piston 4 shown in FIG. 3, in which the section of a cone 6 is adjacent to the valve seat 7, the closing element 34 of the pilot seat valve 33 is also maintained in the closed position interrupting the connection between the left-hand hollow space 23 and the spring area 9. The external sleeve 38 is also pressed onto the shoulder in the internal through-hole 32 by the pre-loaded force acting on the closing element 34, the radial bores 39 being closed by the sleeve wall.

As can also be seen in FIG. 3, in this exemplary embodiment, the valve seat 7 of the section of the cone 6

(i.e., its interior diameter), which, compared to each of the identical interior diameters of the right-hand and left-hand sleeves 17 and 20 that guide the three annular collars 8, 22 and 25 for bearing the valve piston 4, flares radially through a large-diameter bore. In the closed condition of the valve seat 7, an annular space 40 is being formed between the section of the cone 6 and the right-hand sleeve 25 bearing the valve piston 4. Leading into this annular space 40 are a number of bores 41 running diagonally outward; these open into the internal through-hole 32 of the valve piston 4 and are also closed by the external sleeve 38 of the pilot seat valve 33 when the section of the cone 6 (i.e., of the pilot seat valve 33) is in its closed condition. The exterior sleeve 38 has a recess 42 has on its lateral surface. The recess 42 has a width that corresponds to the axial distance between the radial and diagonal bores 39 and 41 of the valve piston 4. However, the recess 42 is arranged such that there is no fluid connection between the radial bores 39 and the diagonal bores 41 when the pilot seat valve 33 is in the closed position as shown.

The functions for actuating pressure and holding a hydraulic device in place are essentially the same as for the first exemplary embodiment in accordance with FIG. 2, so that these will not be described again at this time.

When there is a regulated release of pressure, in the example in accordance with FIG. 3, a control pressure is applied via the pressure control connection $P_{st}$ to the setting piston 18 and the pressure bar 36 is displaced to the left inside the valve piston 4 in accordance with FIG. 3. This first causes the closing element 34 of the pilot seat valve 33 to be lifted from its valve seat, whereby the hydraulic pressure in the left-hand hollow space 23 is released into the oil leakage line 10 through the valve seat, the internal through-hole 32 of the valve piston 4, and the spring area 9. However, since as described in the foregoing, the valve seat 7 of the valve piston 4 flares radially, the essential pressure-engaging surface of the section of the cone 6 that leads to the hydraulic device chamber 15 is greater than the corresponding engaging surface of the left-hand annular collar 22 at the valve piston 4, so that a resultant residual pressure force acts on the section of the cone 6 in the closing direction, depending on the hydraulic device pressure.

At this point, however, if the pressure bar 36 in accordance with FIG. 3, is displaced further to the left, it takes the exterior sleeve 38 of the pilot seat valve 33 with it, the radial bores 39 being connected via the recess 42 to the diagonal bores 41 in the valve piston 4 and a pressure correlating to the hydraulic device pressure is able to build up in the annular chamber 40. At this moment there is essentially a balance of forces at the section of the cone 6 of the valve piston 4, the force of pressure between the section of the cone 6 and its valve seat 7 being determined solely from the force of the pre-loaded spring 5 of the valve piston 4 and therefore being independent of the hydraulic device pressure. It is not until this point that the setting piston 18 becomes adjacent to the right-hand face of the valve piston 4 (i.e., its extension 30) in order to displace it to the left solely against the force of the pre-loaded spring 5 in accordance with FIG. 3 and to open the valve seat 7 at the valve piston 4 proportional to the pilot pressure. The reason for this special design of the servovalve, especially in terms of the radial flare of the valve seat 7, is that when there is particularly high hydraulic device pressure, the section of the cone 6 is pressed with a correspondingly high force of pressure against its valve seat 7. This can cause material failure especially on the interior diameter of the right-hand sleeve 17, which can lead to the valve piston 4 jamming. The radial flare of the valve seat 7 with the subsequent annular space 40 which acts as a buffer for plastic deformation of the valve seat 7, eliminates this risk.

Figure 4:
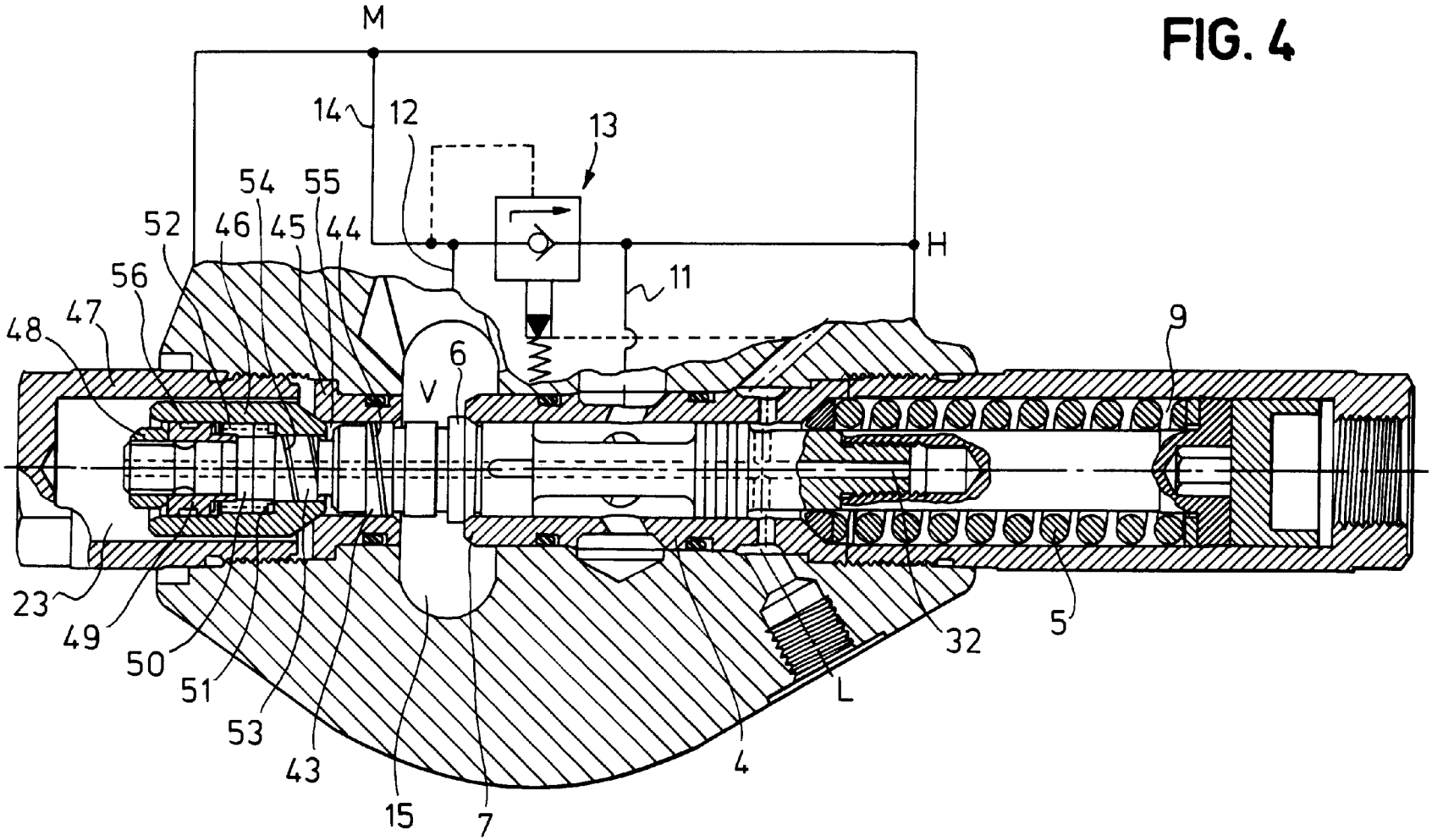

FIG. 4 illustrates an additional exemplary embodiment of the invention; only the differences between it and the first exemplary embodiment will be explained in the following. As can be seen in FIG. 4, the valve piston 4 does not comprise an internal pilot seat valve; however, the left-hand hollow space 23 is in permanent communication with the right-hand spring area 9 via the through-hole 32 in the valve piston 4. The reason for this is that the left-hand hollow space 23 is maintained without pressure, the force of pressure between the section of a cone 6 and the valve seat 7 being determined solely from the spring force of the pre-loaded spring 5 of the valve piston 4.

In order to achieve this, the valve piston 4 comprises at its left-hand end section (as shown in accordance with FIG. 4) a first annular collar 43 having an external helical groove 44 that is slide-borne in a sleeve 45 fixed in the valve housing. The sleeve 45 at its end that is turned away from the hydraulic device chamber 15 is closed by a hollow frustum of a cone 46 that is enclosed by a fluid-tight lining 47 threaded into the valve housing and that is penetrated by the valve piston 4. In order to keep the frustum of the cone 46 adjacent to the sleeve 45, at the left-hand end of the valve piston 4, a shaft nut 48 is threaded, fixing a shaft annular 49 that is borne in the frustum of the cone 46 and that is sealed by means of a seal 56 against it to a corresponding shoulder 50 on the valve piston 4. The shaft annular 49 acts as bearing for a spring 51 that pre-loads the frustum of the cone 46 against the sleeve 45. An annular space 52 between the frustum of the cone 46 and the valve piston 4 for accommodating the pre-loaded spring 51 is separated from the hydraulic device chamber 15 by a second annular collar 53 of the valve piston 4 that is inserted after the first annular collar 43 mentioned in the foregoing; it is slide-borne in the hollow frustum of the cone 46 and has a helical connecting groove 54 on its lateral surface.

The manner in which this embodiment functions can be described as follows:

If the section of the cone 6 of the valve piston 4 is held on its valve seat 7 by the pre-loaded force of the pre-loaded spring 5 (in this condition the hydraulic device-dependent forces of pressure on the section of the cone 6 and the hydraulic device-dependent forces of pressure on the left-hand first annular collar 43 increase significantly), hydraulic fluid reaches the annular space 52 accommodating the pre-loaded spring 51 inside the frustum of the cone 46 via the connecting groove 44 in the first annular collar 43 through an intermediate space 55 between the annular collars 43 and 53 and through the connecting groove 54 in the second left-hand annular collar 53.

If the valve piston 4 is displaced to the left for opening the valve seat 7 in accordance with FIG. 4, the left-hand first annular collar 43 strikes against the frustum of the cone 46 even after it has traveled only a small distance on the displacement path and lifts it from the left-hand sleeve 45. Because of this, hydraulic fluid can flow through the annular groove 44 at the lateral surface of the first annular collar 43 directly into the lining 47 surrounding the frustum of the cone 46, causing the leakage to increase slightly. If the valve piston 4 in accordance with FIG. 4 moves to the right again to the closed position, the frustum of the cone 46 gradually moves to a position adjacent to the left-hand sleeve 45 in order to close it and therefore to cause the leakage losses to decrease again.

The reason for these constructively complex measures is that as a result of the relatively large setting or displacement path of the valve piston 4 and because of the high hydraulic device pressure, a shaft seal (e.g., a radial packing ring) between the sleeve 45 and the valve piston 4 as the sole seal would fail rapidly. In order to prevent this, the frustum of the cone 46 is located adjacent to the sleeve 45 when there is pressure actuation and pressure release—therefore, the shaft seal 56 is only slightly stressed because of the annular collars 43 and 53 that are inserted. Furthermore, the seal 56 only moves slightly when the valve piston 4 is displaced for releasing pressure of the hydraulic device, so that there is no wear caused by friction and therefore the effectiveness of the seal is maintained.

What is claimed is:

1. A pipe rupture valve, having an integrated servovalve (1) that comprises;

at least two internal pressure connections; and one valve piston that is pre-loaded via a pre-loaded spring in a position that separates said pressure connections;

said valve piston having a first steering edge by means of which one of said pressure connections can be closed, characterized in that an annular collar at said valve piston is at a distance axially to said first steering edge and seals a low pressure area relative to said pressure connections characterized by a valve connection that can be selectably connected to a pump or tank and a hydraulic device connection, these being connected to each other via a pressure forwarding channel having an inserted pressure control/feed valve to which a return channel is parallel switched and into which said servovalve is inserted.

2. A pipe rupture valve having an integrated servovalve comprising:

at least two internal pressure connections;

a valve piston that is pre-loaded via a pre-loaded spring in a position that separates said pressure connections; the valve piston (4) having a first steering edge by which one of said pressure connections can be closed, the first steering edge comprising a valve disc that can, by the force of said pre-loaded spring, adjoin a valve seat to close said one pressure connection, an accommodating bore in a housing, said valve seat having a sleeve which is inserted into said accommodating bore;

an annular collar at said valve piston at a distance axially to said first steering edge which seals a low pressure area relative to said pressure connections, the annular collar having an exterior diameter essentially equal to that of the valve seat diameter and that is slide-borne in the accommodating bore of the pipe rupture valve housing;

a slide arranged between said annular collar and said housing, fixed in the accommodating bore in said valve housing;

a hydraulic device chamber penetrated by said valve piston, said device chamber conducting hydraulic device pressure within the pipe rupture valve, and having an entry point closeable by said valve disc and an exit point closeable by said annular collar;

a hollow space formed inside said accommodating bore that is separated from said hydraulic device chamber by said annular collar; and characterized in that said hollow space is connected to said hydraulic device chamber via a choke point formed by said annular collar.

3. A pipe rupture valve in accordance with claim 2, characterized in that said hollow space (23) is connected to a leakage line (10) via a channel in which a pilot seat valve (33) is arranged.

4. A pipe rupture valve in accordance with claim 3, characterized in that said channel inside said valve piston (4) is designed as a through-hole (32) that runs axially, said valve piston (4) for its axial displacement being able to be made to engage with a setting piston (18) that chronologically prior to being made to engage puts said pilot seat valve (33) arranged in said valve piston (4) in an open position in order to release the pressure inside said hollow space (23) into said leakage line (10).

5. A pipe rupture valve in accordance with claim 4, characterized in that said valve disc (6) constitutes a frustum of a cone and a cylindrical annular collar (25) is attached to its face that has a smaller diameter, said valve seat (7) being flared radially in its diameter in terms of said annular collar (25) so that a closed annular space (40) is produced between said valve disc (6), said valve seat (7), and said annular collar (25) when said pressure connection (2) is in its closed condition.

6. A pipe rupture valve in accordance with claim 5, characterized in that said pilot seat valve (33) comprises a valve seat that can be closed by a closing element (34), said valve seat being formed in a sleeve (38) that can be displaced axially in said through-hole (32).

7. A pipe rupture valve in accordance with claim 6, characterized in that said displaceable sleeve (38) can be actuated by said setting piston (18) via a pressure rod (36) and chronologically after closing said valve seat (7) via said valve disc (6) blocks a connecting channel (39, 41) between said hydraulic device chamber (15) and said annular space (40).

8. A pipe rupture valve for securing a hydraulic device having an integrated servovalve comprising:

at least two internal pressure connections, a first of which is open toward a hydraulic device connection;

a valve piston which is pre-loaded via a pre-loaded spring in a closing position that separates said pressure connections and in said closing position is seated with a valve disc on a valve seat to which more hydraulic device pressure can be applied in the direction of the closing position;

a control space providing hydraulic device pressure that is in fluid connection via a choke point with said first pressure connection;

a channel axially leading through said valve piston allowing pressure to be released from said control space and via a pilot valve designed as a seat valve, and wherein said valve piston for its axial displacement in the opening direction engages with a setting piston that prior to engaging with said valve piston puts said pilot seat valve in an open position to release the hydraulic device pressure from said control space;

a spring area opposite said control space with respect to said valve piston accommodating said pre-loaded spring, said spring area being free of pressure;

an annular collar;

an open annular space provided between said annular collar and said valve disc; and wherein said annular collar is open toward said second pressure connection at said valve piston at an axial distance from said valve disc and which seals said spring area against said second pressure connection and acts as a sliding bearing of said valve piston and that the pressure is released from said control space into said spring area.

9. A pipe rupture valve according to claim 8, further comprising:

a housing of said pipe rupture valve;

an accommodating bore bored into said housing; and wherein said valve seat is formed by a sleeve which is inserted into said accommodating valve.

10. A pipe rupture valve according claim 8, further comprising a further annular collar which also acts as a sliding guide for said valve piston, the further annular collar is provided between said valve disc and said sliding bearing immediately adjacent to said valve disc.

11. A pipe rupture valve according to claim 8, characterized in that said spring area is in permanent communication with a leakage connection of said pipe rupture valve.

12. A pipe rupture valve according to claim 8, further comprising:

a valve connection which can be selectably connected to a pump or a tank;

a hydraulic device connection; and a pressure forwarding channel connecting said valve connection and said hydraulic device connection, said pressure forwarding channel having an inserted pressure control/feed valve, to which a return channel is switched in parallel into which said servovalve is inserted.

13. A pipe rupture valve according to claim 9, characterized in that said valve piston is on an end section opposite to said valve disc and is provided with an annular collar with an exterior diameter which is essentially equal to that of said valve disc and which is slide-borne in said accommodating bore of said pipe rupture valve housing.

14. A pipe rupture valve according to claim 13, further comprising a slide bush that is arranged between said annular collar and said housing and that is fixed in the accommodating bore in said valve housing.

15. A pipe rupture valve according to claim 13, characterized in that said valve piston penetrates a hydraulic device chamber conducting a hydraulic device pressure within said pipe rupture valve, an entry point being closeable by said valve disc and an exit point being closeable by said annular collar.

16. A pipe rupture valve according to claim 15, further comprising a hollow space formed inside said accommodating bore on a side of said valve piston opposite said pre-loaded spring, said hollow space being separated from said hydraulic device chamber by said annular collar and constituting said control space.

17. A pipe rupture valve according to claim 16, characterized in that said choke point is constituted by said annular collar and is directly connected to said hydraulic device chamber into which said first pressure connection opens.

18. A pipe rupture valve according to claim 16, characterized in that said hollow space is connected to a leakage line via a channel in which said pilot seat valve is arranged.

19. A pipe rupture valve according to claim 18, characterized in that said valve disc is constituted by the frustum of a cone and said cylindrical annular collar is attached to the face thereof having a smaller diameter, said valve seat being flared radially in its diameter in terms of said annular collar so that a closed annular space is formed between said valve disc, said valve seat and said annular collar when said pressure connection is in its closed condition.

20. A pipe rupture valve according to claim 18, characterized in that said pilot seat valve comprises a valve seat that is closed by a closing element, said valve seat being formed in a sleeve which is axially displaceable in said channel.

21. A pipe rupture valve according to claim 20, characterized in that said displaceable sleeve is actuated by said setting piston via a pressure rod and wherein closing said valve seat, via said valve disc, blocks a connecting channel between said hydraulic device chamber and said annular space.

* * * * *